US008739864B2

(12) United States Patent
Crider et al.

(10) Patent No.: US 8,739,864 B2
(45) Date of Patent: Jun. 3, 2014

(54) DOWNHOLE MULTIPLE CYCLE TOOL

(75) Inventors: James Alan Crider, Houston, TX (US); Gregory L. Hern, Porter, TX (US); Charles W. Pleasants, Cypress, TX (US)

(73) Assignee: Baker Hughes Incorporated, Houston, TX (US)

( * ) Notice: Subject to any disclaimer, the term of this patent is extended or adjusted under 35 U.S.C. 154(b) by 382 days.

(21) Appl. No.: 12/826,020

(22) Filed: Jun. 29, 2010

(65) Prior Publication Data

US 2011/0315389 A1 Dec. 29, 2011

(51) Int. Cl.
*E21B 23/00* (2006.01)

(52) U.S. Cl.
USPC ..... 166/240; 166/318; 166/331

(58) Field of Classification Search
USPC ..... 166/239, 340, 334.4, 318, 331, 373, 166/326, 193, 194; 175/317, 237
See application file for complete search history.

(56) References Cited

U.S. PATENT DOCUMENTS

| | | | | |
|---|---|---|---|---|
| 2,771,968 | A * | 11/1956 | Mercier | 188/312 |
| 4,889,199 | A | 12/1989 | Lee | 175/317 |
| 5,499,687 | A | 3/1996 | Lee | 175/317 |
| 6,412,614 | B1 * | 7/2002 | Lagrange et al. | 188/281 |
| 6,866,100 | B2 | 3/2005 | Gudmestad et al. | |
| 7,281,584 | B2 | 10/2007 | McGarian et al. | 166/323 |
| 7,416,029 | B2 | 8/2008 | Telfer et al. | 166/386 |
| 7,464,764 | B2 | 12/2008 | Xu | 166/376 |
| 7,581,596 | B2 * | 9/2009 | Reimert et al. | 166/386 |
| 7,628,210 | B2 | 12/2009 | Avant et al. | 166/373 |
| 7,637,323 | B2 | 12/2009 | Schasteen et al. | 166/318 |
| 7,644,772 | B2 | 1/2010 | Avant et al. | 166/373 |
| 2003/0024706 | A1 * | 2/2003 | Allamon | 166/373 |
| 2006/0272824 | A1 | 12/2006 | Adams | |
| 2007/0107944 | A1 * | 5/2007 | Lee | 175/317 |
| 2009/0056934 | A1 | 3/2009 | Xu | |
| 2010/0018713 | A1 * | 1/2010 | Smith | 166/311 |

FOREIGN PATENT DOCUMENTS

| | | |
|---|---|---|
| WO | WO 00/66879 A1 | 11/2000 |

* cited by examiner

*Primary Examiner* — Kenneth L Thompson
*Assistant Examiner* — Ronald Runyan
(74) *Attorney, Agent, or Firm* — Shawn Hunter

(57) ABSTRACT

A tool for use in a wellbore which includes a housing having an axial flow bore and a piston sleeve moveably disposed within the flow bore. The tool is moveable between first and second operating positions by an actuation mechanism having a piston with a ball seat. The tool can be moved between first and second operating positions with the use of actuating balls of different sizes that can be landed upon the ball seat.

18 Claims, 9 Drawing Sheets

DOWNHOLE MULTIPLE CYCLE TOOL

BACKGROUND OF THE INVENTION

1. Field of the Invention

The invention relates generally to circulation valves and sliding sleeve tools. In particular aspects, the invention relates to actuation mechanisms for such tools.

2. Description of the Related Art

Wellbore tools have been designed which are operated by the use of a ball or plug that is landed on a seat within the flowbore of the tool string. The ball or plug serves to increase pressure and/or redirect fluid flow through the tool in order to operate the tool. Tools of this type include circulation valves which are used to selectively open and close lateral fluid flow ports in a tool sub to permit fluid flowing axially through the tool to be diverted into the surrounding flowbore. Circulation valves of this type are described in U.S. Pat. No. 4,889,199 issued to Lee, U.S. Pat. No. 5,499,687 issued to Lee, U.S. Pat. No. 7,281,584 issued to McGarian et al. and U.S. Pat. No. 7,416,029 issued to Telfer et al.

SUMMARY OF THE INVENTION

An exemplary circulation valve is described that includes a substantially cylindrical housing with a central axial flow bore and a piston sleeve moveably disposed within the flow bore. The tool includes an outer housing that defines an axial flow bore. Outer lateral flow ports are disposed through the housing. The housing retains a piston sleeve having inner lateral flow ports, and movement of the piston sleeve within the housing will bring the inner flow ports into and out of alignment with the outer flow ports.

An indexing mechanism is used to control the axial position of the piston sleeve within the housing. This indexing mechanism allows the tool to be cycled alternately between a first operating position, wherein the outer lateral flow ports are closed off to fluid flow, and a second operating position, wherein the outer lateral flow ports are open to fluid flow. In a described embodiment, the indexing mechanism includes an indexing sleeve with a lug pathway inscribed thereupon. Lugs are carried by the housing and are disposed within the lug pathway to move between various positions within the pathway as the piston sleeve is moved axially. The axial position of the piston sleeve is governed by the location of the lugs within the lug pathway.

The tool also features an actuation mechanism that allows the tool to be switched between its first and second operating positions by means of dropped balls or plugs that are landed onto a ball seat within the piston sleeve. In a currently preferred embodiment, the ball seat is formed by one or more dogs that are retained within slots in the piston sleeve. The actuation mechanism features an expansion chamber that retains the dogs in a radially restrictive manner. The expansion chamber features chamber portions having different diameters. In a described embodiment, the expansion chamber has at least three chamber portions having progressively increasing diameters.

Varied fluid pressure is used to move the piston sleeve axially downwardly against a biasing force, such as a spring. Downward movement of the piston sleeve moves the dogs into an expansion chamber portion of increased diameter. The increased diameter permits the dogs to move radially outwardly, releasing an actuation ball. The tool requires one size of actuation ball to move the tool from a first operating position to a second operating position and a second size of actuation ball to move the tool from the second operating position back to the first operating position.

During the process of dropping balls through the bore of the tool, and a positive feedback indication is provided to a surface operator via the resultant fluid pressure in the tool string whereby operation of the tool is confirmed.

According to another aspect of the invention, the tool preferably incorporates a damper to control the relative velocity of movement of the piston and body during operational cycles. The damper helps to prevent damage to the indexing mechanism operation of the tool.

BRIEF DESCRIPTION OF THE DRAWINGS

The advantages and further aspects of the invention will be readily appreciated by those of ordinary skill in the art as the same becomes better understood by reference to the following detailed description when considered in conjunction with the accompanying is drawings in which like reference characters designate like or similar elements throughout the several figures of the drawing and wherein.

DETAILED DESCRIPTION OF THE PREFERRED EMBODIMENTS

Figure 1:
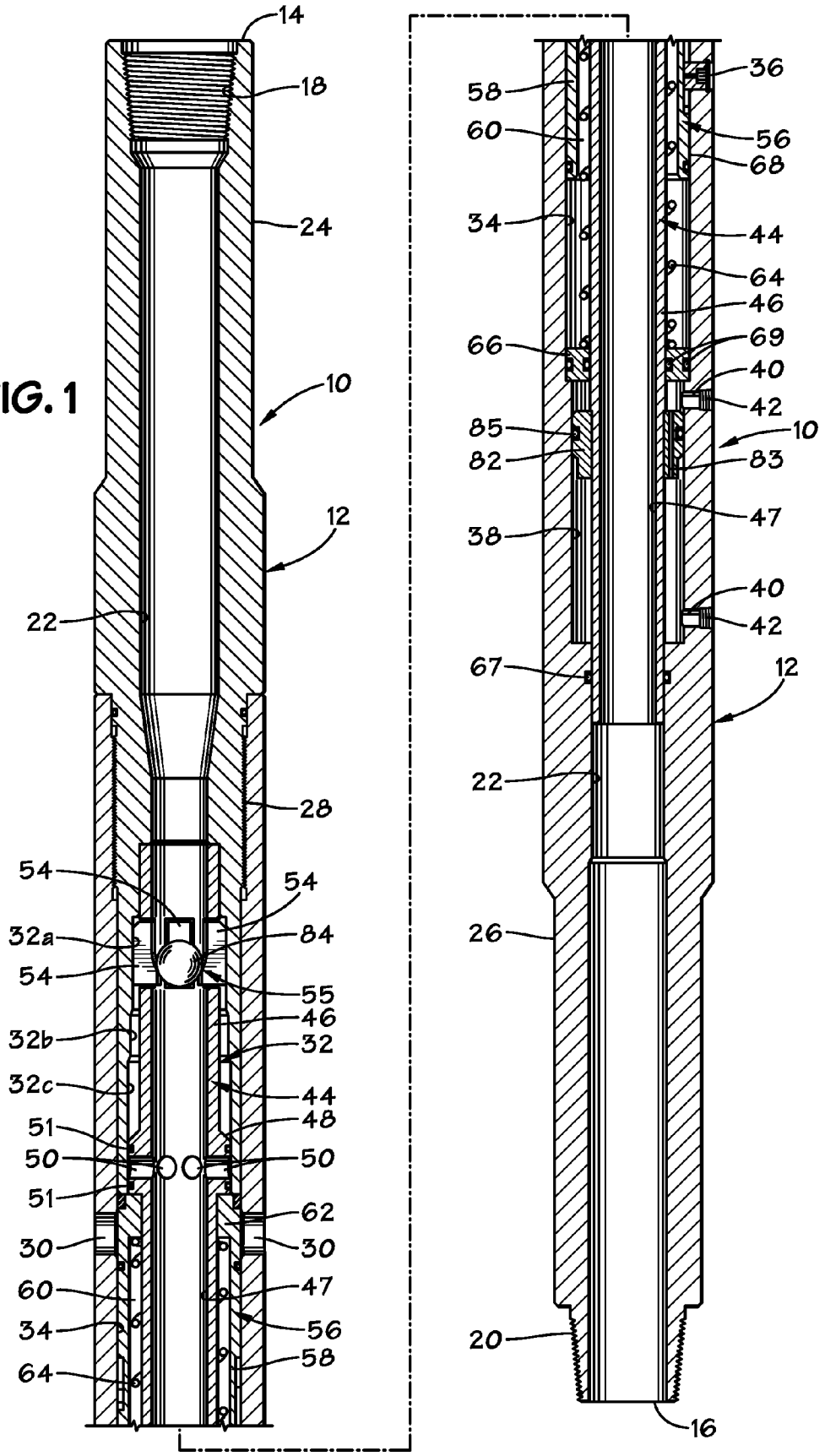
FIG. 1 is a side, cross-sectional view of an exemplary circulation sub tool constructed in accordance with the present invention in a first operating position.

FIGS. 1-4 illustrate an exemplary circulation valve tool 10 that is constructed in accordance with the present invention. The upper portion of the tool 10 is shown on the left-hand side of FIGS. 1-4 while the lower portion of the tool 10 is shown on the right-hand side of FIGS. 1-4. The circulation valve tool 10 includes a generally cylindrical outer housing 12 that presents an upper axial end 14 and a lower axial end 16. The upper end 14 includes a box-type threaded connection 18, and the lower end 16 provides a pin-type threaded connection 20. The connections 18, 20 are of a type known in the art for incorporating the tool 10 into a tool string (not shown) and disposed in a wellbore. The housing 12 defines a central flow bore 22 along its length. In a preferred embodiment, the housing 12 is made up of an upper sub 24 and a lower sub 26 that are threaded together at connection 28. Outer lateral fluid ports 30 are disposed through the housing 12.

Located within the housing 12, and preferably within the lower end of the upper sub 24, is a stepped expansion chamber, generally shown at 32. FIG. 1A depicts this chamber 32 in greater detail. As best seen there, the expansion chamber 32 includes three chamber portions 32*a*, 32*b* and 32*c* having interior diameters that sequentially increase. The chamber portion 32*a* has the smallest diameter. The large diameter chamber portion 32*c* has the largest diameter. The intermediate diameter chamber portion 32*b* has a diameter that is greater than the small chamber portion 32*a* but is smaller than that of the large diameter chamber portion 32*c*.

An indexing chamber 34 is defined within the housing 12 below the expansion chamber 32. One or more indexing lugs 36 are disposed through the housing and protrude into the indexing chamber 34. Although only a single lug 36 is visible in FIGS. 1-4, it is currently preferred that there be multiple lugs 36 that are angularly spaced about the circumference of the housing 12.

Below the indexing chamber 34, a damping chamber 38 is defined within the housing 12. Lateral fill ports 40 are disposed through the housing 12 and closed off with plugs 42.

A piston sleeve 44 is disposed within the flow bore 22. The piston sleeve 44 has a generally cylindrical body 46 which defines a central flow path 47. A flange 48 projects radially outwardly from the body 46 and has inner radial fluid ports 50 disposed within. Annular fluid seals 51 surround the body 46 and seal against the surrounding housing 12, thereby isolating the fluid ports 50. A plurality of longitudinal slots 52 (see FIG. 1A) are formed within upper end of the body 46. Preferably, there are four such slots 52, three of which are visible in FIG. 1A. However, there may be a different number of said slots 52, if desired. Preferably also, the slots 52 are spaced equidistantly about the circumference of the body 46. Each slot 52 contains a dog 54, which can be moved radially inwardly and outwardly through the slot 52. It is currently preferred that the dogs 54 be generally rectangular in shape and present inwardly projecting lower portions. The dogs 54 collectively form a ball seat, generally indicated by the reference numeral 55. When the dogs 54 are located within the most restricted diameter portion 32*a*, the ball seat 55 will have a smaller diameter opening such that both a smaller actuation ball 84 and a larger actuation ball 86 can be seated upon the ball seat 55. When the dogs 54 are located within the intermediate diameter chamber portion 32*b*, the ball seat 55 will provide a larger diameter central opening such that the larger actuation ball 86 will still be captured by the ball seat 55. However, the smaller actuation ball 84 will pass through the ball seat 55. When the dogs 54 are located within the largest diameter chamber portion 32*c*, the ball seat 55 will provide an even larger diameter central opening that will permit both the smaller ball 84 and the larger ball 86 to pass through the ball seat 55.

An indexing sleeve 56 surrounds a lower portion of the body 46 within the indexing chamber 34 and is moveable within the indexing chamber 34. The indexing sleeve 56 is generally cylindrical and has a radially enlarged skirt portion 58. An annular spring chamber 60 is defined radially between the skirt portion 58 and the body 46 of the piston sleeve 44. The upper end of the indexing sleeve 56 has an inwardly extending flange 62 which engages the body 46. A compression spring 64 surrounds the piston sleeve 44 and resides generally within the spring chamber 60. The upper end of the compression spring 64 abuts the flange 62 while the lower end of the spring 64 abuts an annular plug member 66 which is disposed within the indexing chamber 34 and seals off the indexing chamber 34 from the damping chamber 38. It is noted that an annular fluid seal 67 forms a seal between the lower sub 26 and the piston sleeve 44. Fluid seals 69 are located around and within the plug member 66 to provide sealing against the piston sleeve 44 and the indexing chamber 34.

As can be seen with reference to FIGS. 5-8, the indexing sleeve 56 presents an outer radial surface 68 that has a lug pathway 70 inscribed therein. The lug pathway 70 is shaped and sized to retain the interior ends of each of the lugs 36 within. The lug pathway 70 generally includes a central circumferential path 72. A plurality of legs extends axially away from the central path 72. The pathway 70 is designed such that the number of each type of leg equals the number of lugs 36 that are used with the pathway 70. Long legs 74 and short legs 76 extend axially downwardly from the central path 72. In addition, long legs 78 and short legs 80 extend axially upwardly from the central path 72.

Referring once again to FIGS. 1-4, it is noted that a damping piston 82 is disposed within the damping chamber 38. The damping piston 82 is securely affixed to the piston sleeve 44 and contains one or more restrictive fluid flow orifices 83 which extend entirely through the damping piston 82. Fluid seal 85 radially surrounds the damping piston 82 and forms a fluid seal against the interior wall of the damping chamber 38. A hydraulic fluid fills the damping chamber 38 both above and below the damping piston 82.

The tool 10 can be repeatedly switched between a first operating position, wherein the outer fluid ports 30 are closed against fluid flow, and a second operating position, wherein the outer fluid ports 30 are open to fluid flow. To do this, actuation balls 84 and 86 are dropped into the flow bore 22 of the tool 10 to cause the tool 10 to be actuated between these positions. Ball 84 is of a smaller size than ball 86. It is further noted that, while spherical balls are depicted for both balls 84 and 86, a spherical member is not necessary. In fact, darts or plugs of other shapes and configurations might also be used and such are intended to be included within the general meaning of the word "ball" as used herein. When the tool 10 is initially made up into a tool string and run into a wellbore, it is typically in the first operating position shown in FIG. 1, although ball 84 is not present. The dogs 54 forming the ball seat 55 are located within the reduced diameter chamber portion 32*a* of the expansion chamber 32. The lugs 36 are located within the long downwardly extending legs 74 (see FIG. 5). In this position, fluid flow through the lateral fluid ports 30 is closed off by the indexing sleeve 56. The interior fluid flow ports 50 also are not aligned with the outer fluid flow ports 30 and fluid seals 51 prevent fluid communication with the interior ports 50. Fluid can be flowed and tools may be passed axially through the flowbore 22 of the tool 10.

Figure 1A:
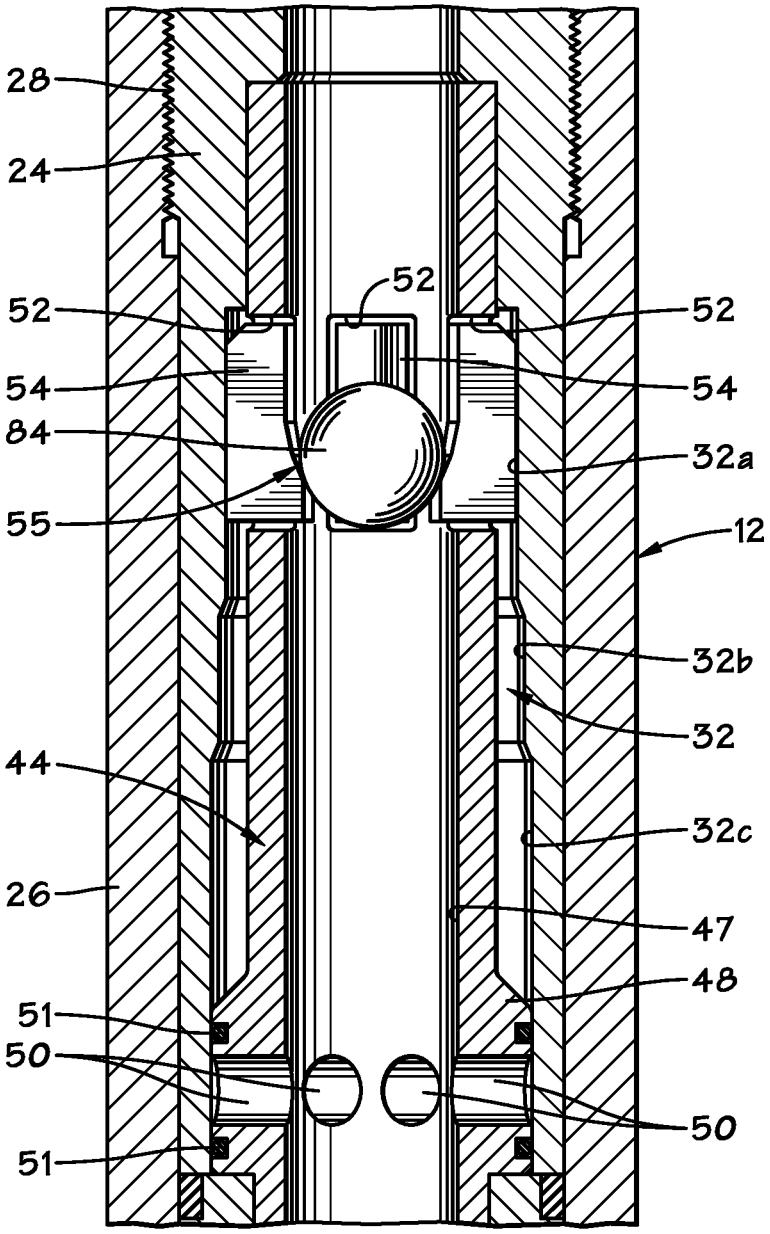
FIG. 1A is an enlarged cross-sectional view of portions of the ball seat of the tool shown in FIG. 1.
Figure 2:
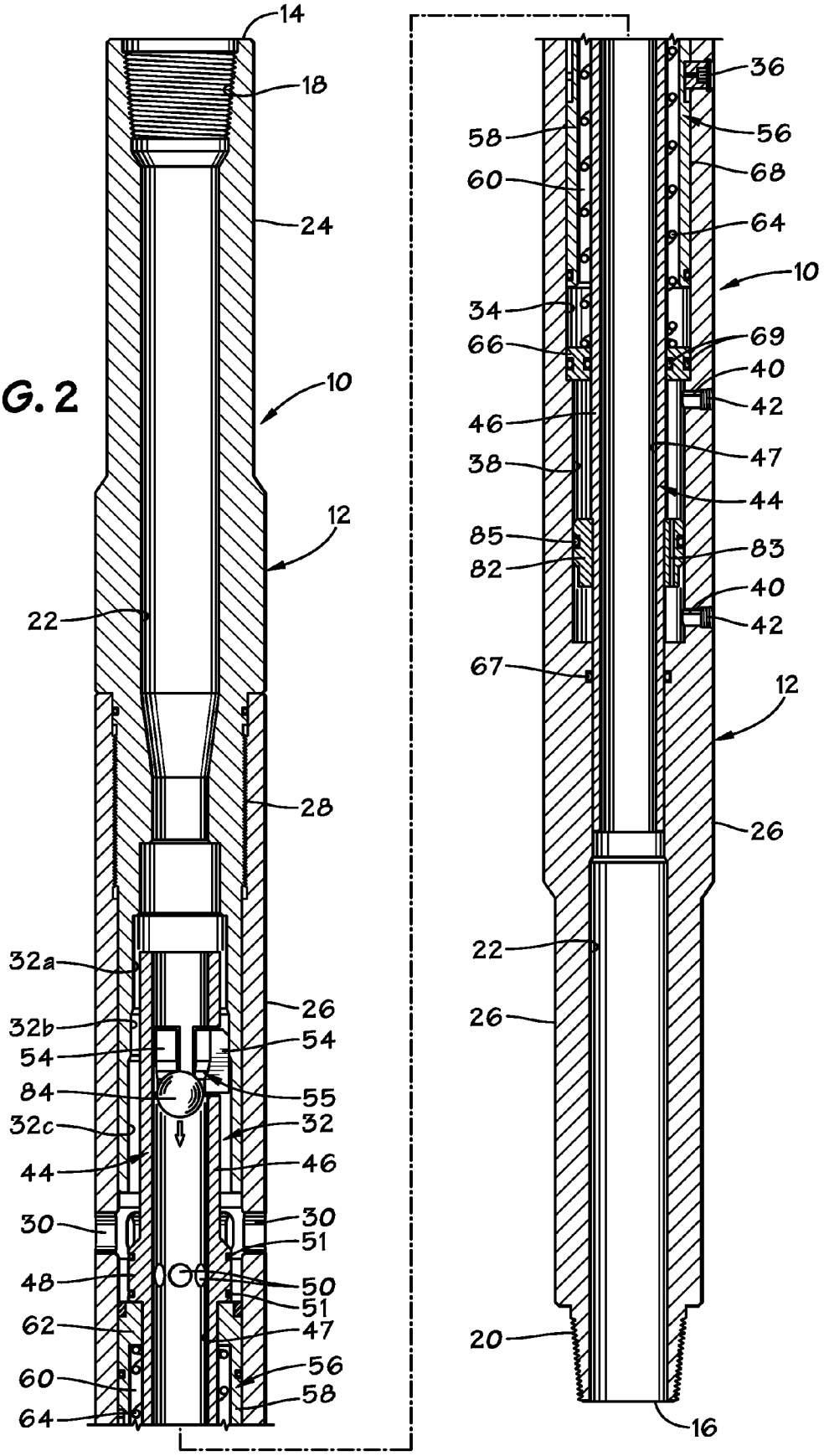
FIG. 2 is a side, cross-sectional view of the tool shown in FIG. 1, now in a first intermediate position.
Figure 3:
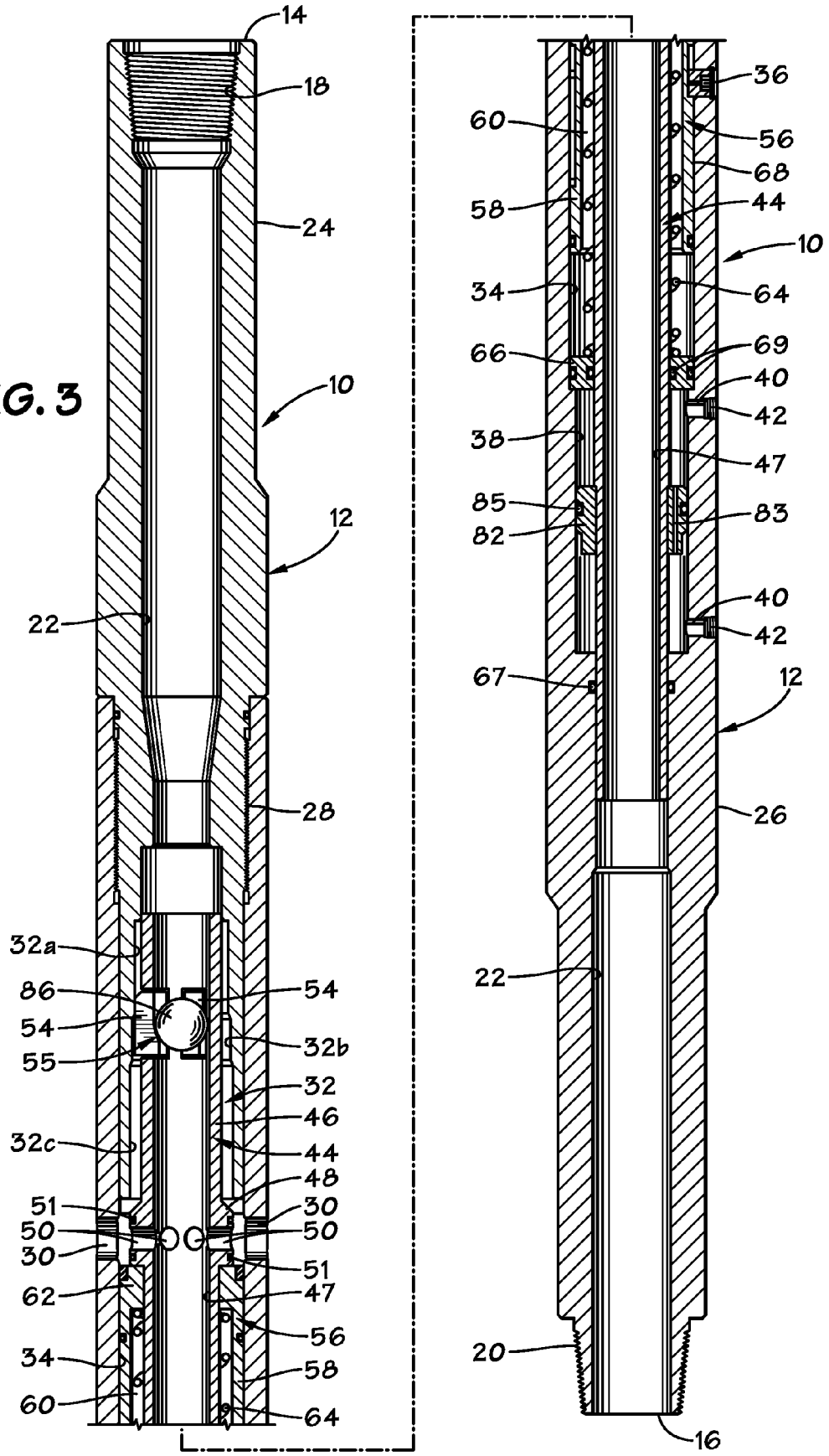
FIG. 3 is a side, cross-sectional view of the tool shown in FIGS. 1-2, now in a second operating position.
Figure 4:
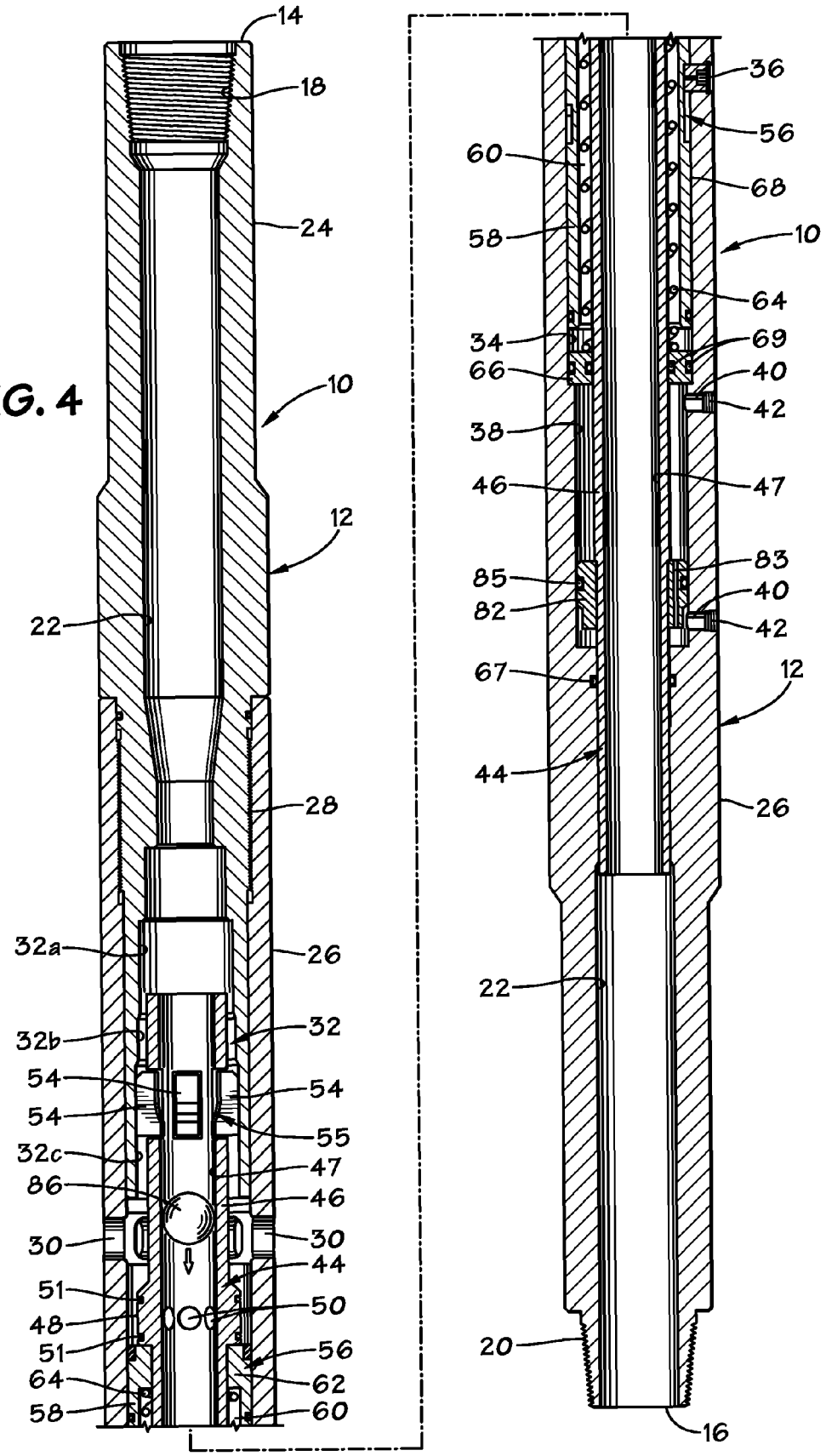
FIG. 4 is a side, cross-sectional view of the tool shown in FIG. 1-3, now in a second intermediate position.

When it is desired to open the lateral fluid ports 30 to permit fluid communication between the flow bore 22 and the surrounding wellbore, the smaller ball 84 is dropped into the flow bore 22 where it lands on the ball seat 55 provided by dogs 54 (see FIGS. 1 and 1A). Fluid pressure is then increased within the flowbore 22 above the landed ball 84. The increased fluid pressure causes the piston sleeve 44 and affixed indexing sleeve 56 to move axially downwardly with respect to the housing 12, as depicted in FIG. 2. The compression spring 64 is compressed. The lugs 36 will move along the pathway 70 to become located within the upwardly extending legs 36 of the pathway 70 (see FIG. 6). As this axial movement occurs, the indexing sleeve 56 and the piston sleeve 44 are rotated within the housing 12.

Figure 6:
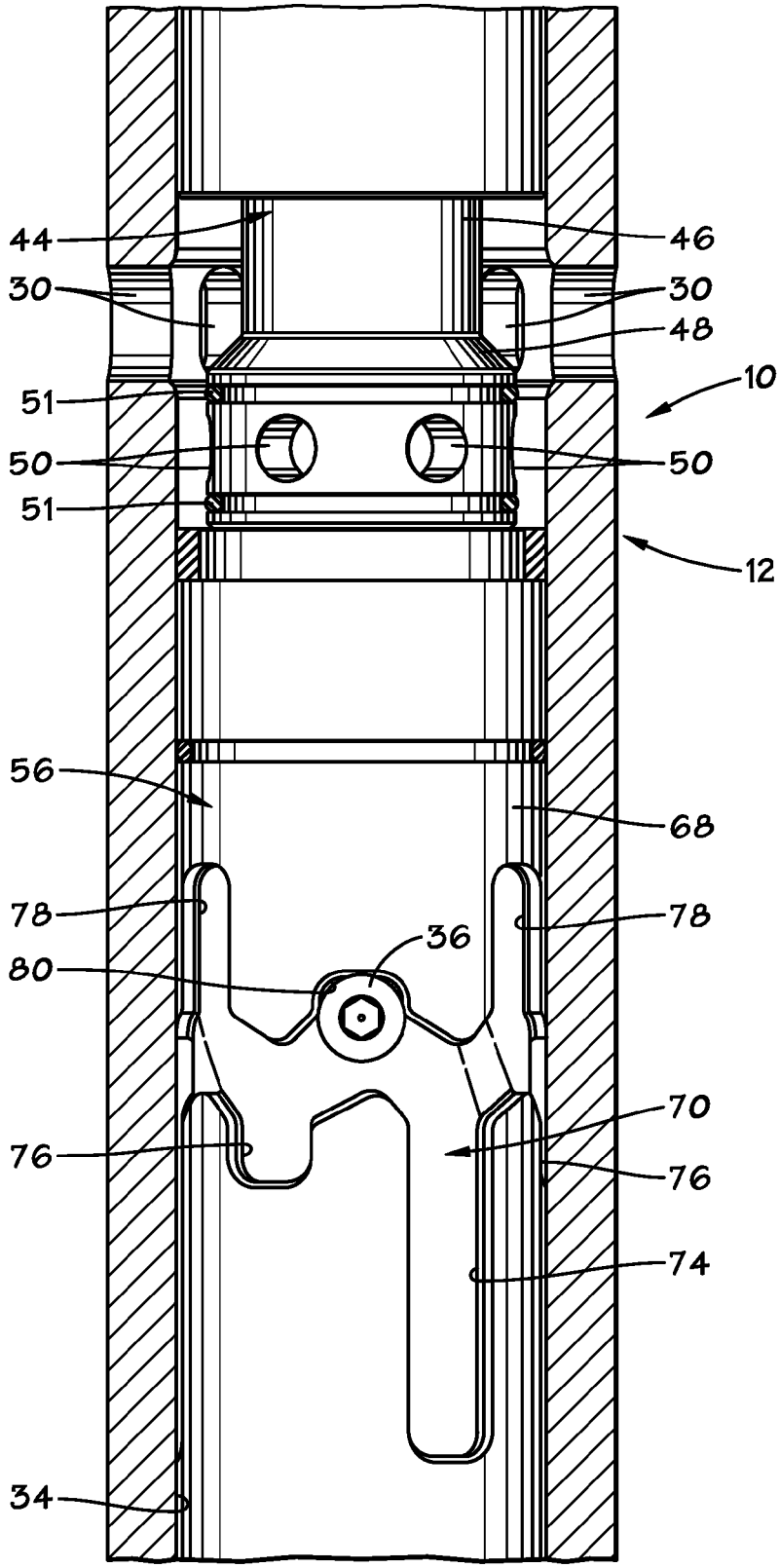
FIG. 6 is an enlarged side, cross-sectional view of the tool portions shown in FIG. 5, now in a first intermediate position.
Figure 7:
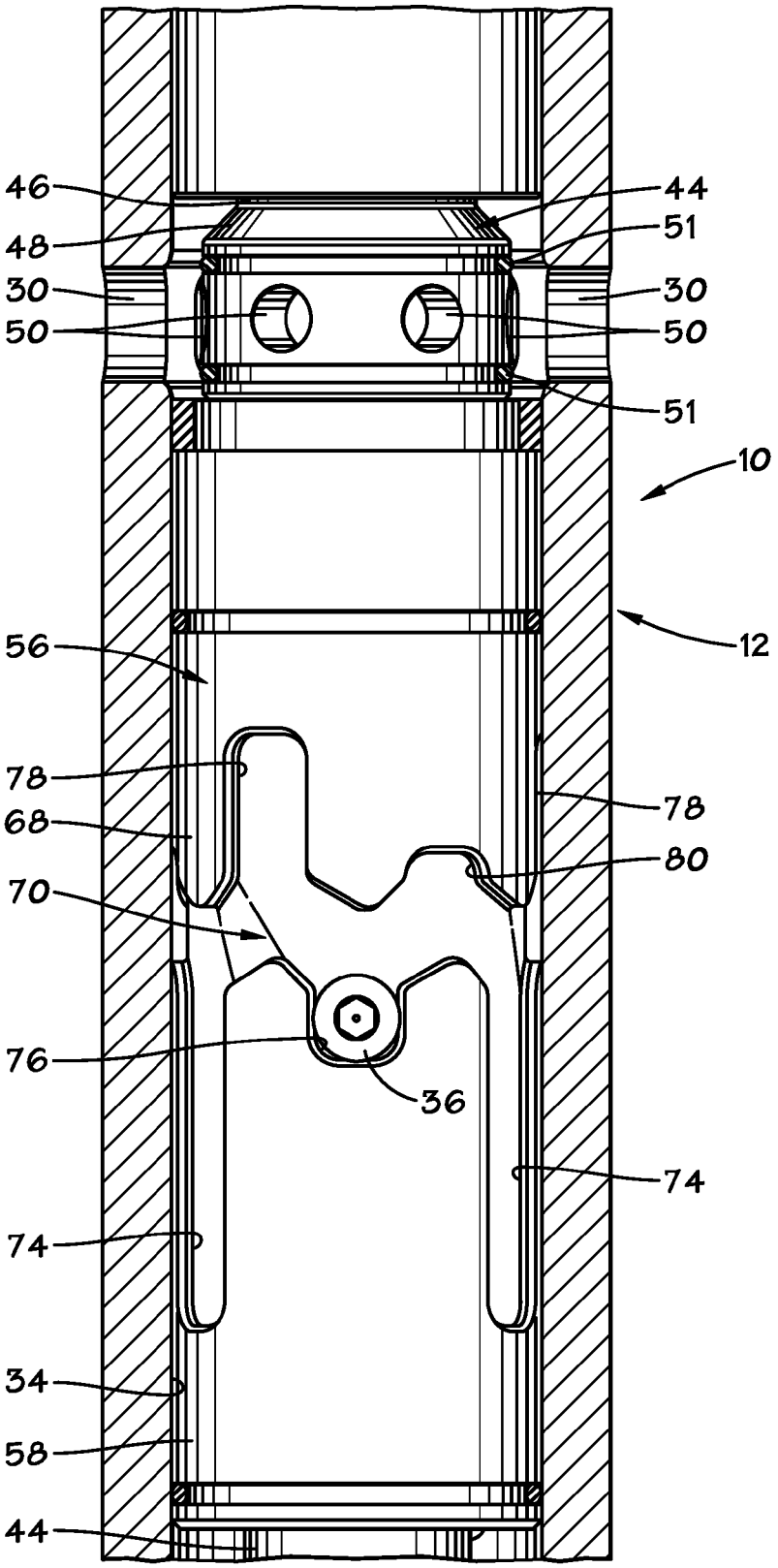
FIG. 7 is an enlarged side, cross-sectional view of the tool portions shown in FIGS. 5 and 6, now in a second operating position.
Figure 8:
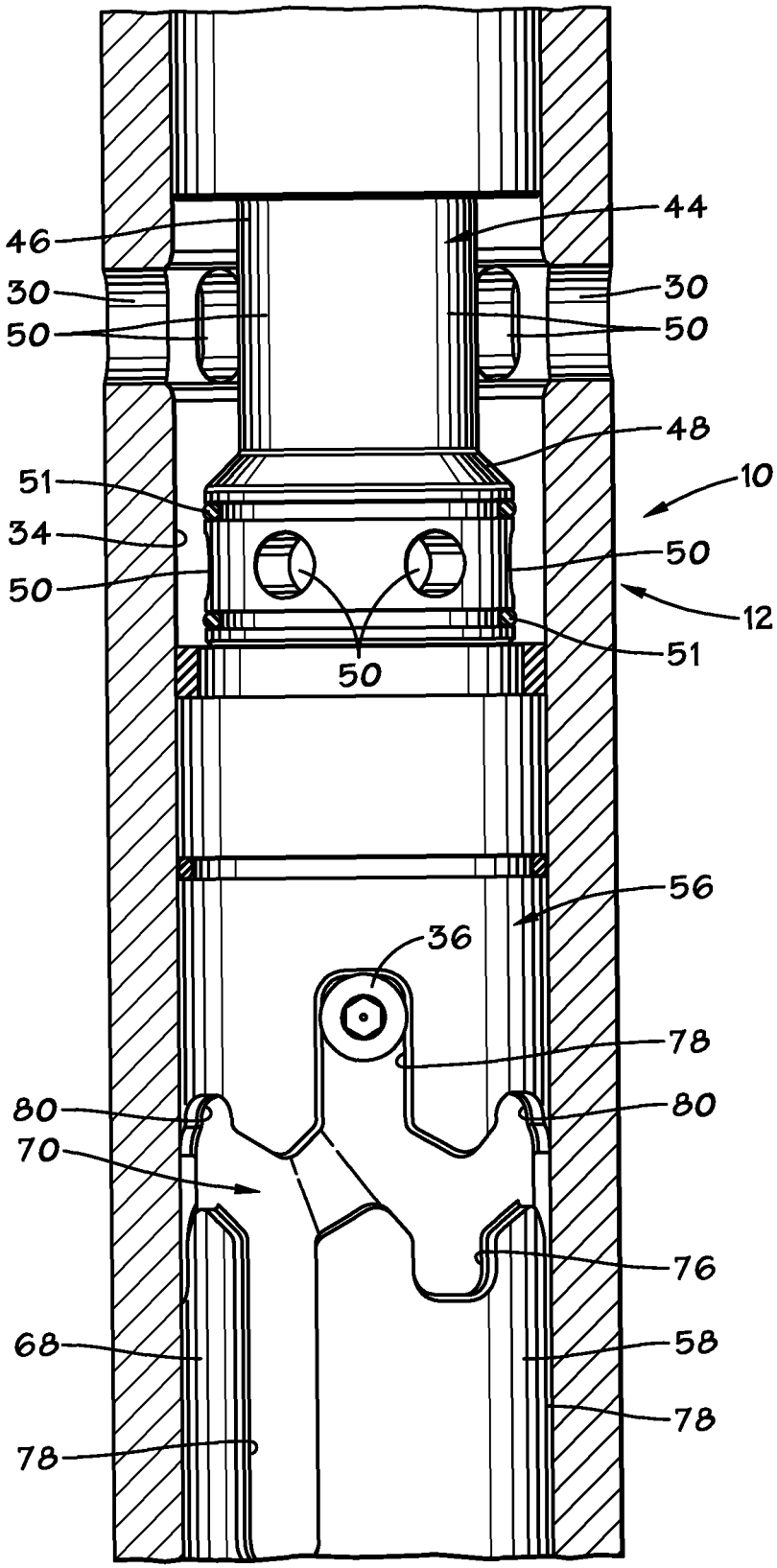
FIG. 8 is an enlarged side, cross-sectional view of the tool portions shown in FIGS. 5-7, now in a second intermediate position.

As the piston sleeve 44 moves axially downwardly to the first intermediate position depicted in FIGS. 2 and 6, the dogs 54 are moved into the larger diameter chamber portion 32*b* of the expansion chamber 32. The enlarged diameter of the chamber portion 32*b* permits the dogs 54 to be moved radially outwardly and release the small ball 84, as shown. The lugs 36 will shoulder out in the short, upwardly-extending legs 80 of the lug pathway 70 when the dogs 54 are in position to release the ball 84. The released ball 84 may be captured by a ball catcher (not shown) of a type known in the art, which is located within the tool string below the tool 10.

After the ball 84 has been released from the ball seat 55, the spring 64 will urge the piston sleeve 44 and indexing sleeve 56 axially upwardly within the housing 12. Upward movement of the piston sleeve 44 and indexing sleeve 56 will end when the lugs 36 shoulder out in the short downwardly extending legs 76 of the lug pathway 70. The tool 10 will now be in the second operating position depicted in FIGS. 3 and 7. In this operating position, the inner fluid flow ports 50 of the piston sleeve 44 are aligned with the outer fluid flow ports 30 of the housing 12 so that fluid may flow between the inner flow bore 22 and the surrounding wellbore. It is also noted that the dogs 54 are now once more located radially within the chamber portion 32*a* of the expansion chamber 32.

Figure 5:
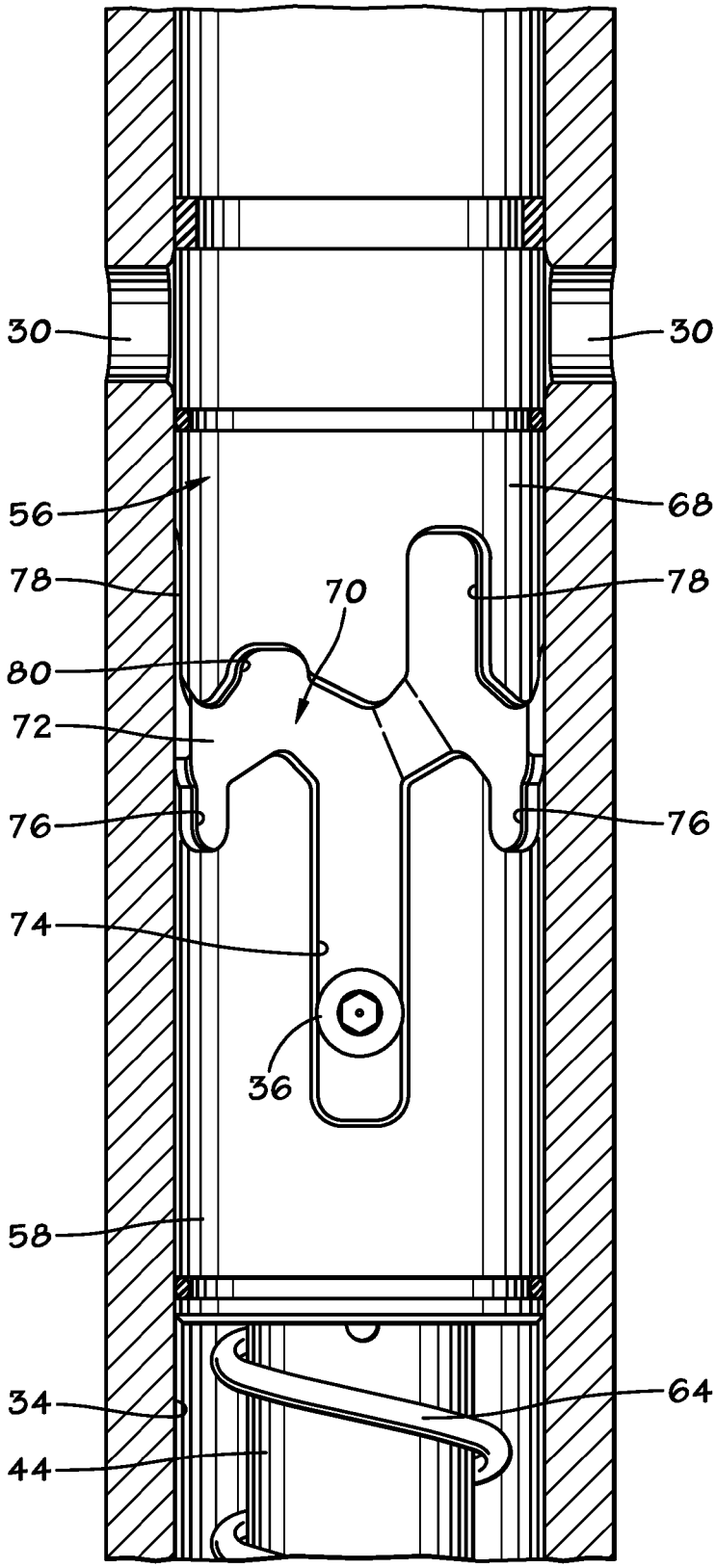
FIG. 5 is an enlarged side, cross-sectional view of portions of the tool shown in FIG. 4, in a first operating position.

When it is desired to return the tool 10 to the first (closed) operating position depicted in FIGS. 1 and 5, the larger ball 86 is dropped into the flow bore 22 and landed upon the ball seat 55. Fluid pressure is then varied and increased within the flow bore 22 above the ball 86. The increased fluid pressure will urge the piston sleeve 44 and indexing sleeve 56 axially downwardly within the housing 12 and compress the spring 64. The tool 10 is now in the second intermediate position depicted by FIG. 4. The lugs 36 are moved into the upwardly extending long legs 78 of the lug pathway 70 (see FIG. 8). As a result, the dogs 54 are moved downwardly into the enlarged diameter chamber portion 32*c* of the expansion chamber 32, thereby allowing the dogs 54 to be moved radially outwardly adequately to allow the larger ball 86 to be released from the ball seat 55.

As the larger ball 86 is released from the ball seat 55, the spring 64 will urge the piston sleeve 44 and the indexing sleeve 56 axially upwardly once more and return the tool to the first operating position illustrated in FIGS. 1 and 5. From this first operating position, it can once more be switched to the second operating position (FIGS. 3 and 7) and back again by repeating the above-described steps. It is noted that the tool 10 can be switched between the first and second operating positions repeatedly by the sequential use of a smaller ball 84 followed by a larger ball 86. Those of skill in the art will understand that, because the lug pathway 70 surrounds the indexing sleeve 56 in a continuous manner, the above-described steps may be repeated to cycle the tool 10 between operating positions.

Only a smaller ball 84 will be useful to move the tool 10 from the first (closed) operating position to the second (open) operating position. If a large ball 86 were landed on the ball seat 55 when the tool 10 is in the first operating position (FIGS. 1 and 5), the large ball 86 would not be released from the ball seat 55 when the seat 55 is moved downwardly into the intermediate diameter chamber portion 32*b* (FIG. 2). The lugs 36 will shoulder out in the legs 80 of the lug pathway 70 (FIG. 6). Pressure within the flowbore 22 will have to be varied to be reduced to permit the tool 10 to move to the position depicted in FIGS. 3 and 7. Thereafter, the fluid pressure can be once again varied and increased within the flowbore 22, which will move the tool 10 to the second intermediate position shown in FIGS. 4 and 8, and the larger ball 86 will be released as the ball seat 55 is moved into the large diameter chamber portion 32*c*.

Conversely, only a larger ball 86 will be useful to move the tool 10 from the second (open) operating position to the first (closed) operating position. If a smaller ball 84 were dropped in intended to be landed on the ball seat 55 when the tool 10 is in the second operating position (FIGS. 3 and 7), it would pass through the ball seat 55 once the ball seat 55 became located within the intermediate diameter chamber portion 32*b*. As a result, with the smaller ball 84, the tool 10 is incapable of being moved to the second intermediate position (FIGS. 4 and 8) because it will release the smaller ball 84 before the tool can reach the second intermediate position.

During the movements of the piston sleeve 44 and indexing sleeve 56 described above, a damping assembly which includes the damping chamber 38 and the damping piston 82 controls the relative velocity of these components within the housing 12. For example, as the piston sleeve 44 is moved axially downwardly within the housing 12 (as it would when moving from the position shown in FIG. 1 to the position shown in FIG. 2) the affixed damping piston 82 will be urged downwardly within the damping chamber 38. Fluid below the damping piston 82 within the damping chamber 38 must be transferred across the damping piston 82 through the orifice 83 in order to accommodate the damping piston 82. This fluid transfer requires some time to occur because the orifice 83 is restrictive. Therefore, the rate of movement of the damping piston 82 and the affixed piston sleeve 44 is slowed.

It should be understood that the tool 10 provides an actuation mechanism that presents a ball seat 55 that will release different sized balls 84 and 86 when the tool 10 is shifted from each of two operating positions. It is also noted that the tool 10 is operated using actuating balls 84 and 86 that are of different sizes. Only the large ball 86 can close the tool 10, and only the small ball 84 can open the tool 10. As a result, it is easy for an operator to keep track of which position the tool 10 is in. This feature helps ensure that unintended return of the tool 10 to its first operating position does not occur. This is because a smaller ball 84 will be released by the ball seat 55 before it moved the indexing sleeve 56 to the first operating position, and only the use of a larger ball 86 will function to return the tool 10 to its first operating position.

The foregoing description is directed to particular embodiments of the present invention for the purpose of illustration and explanation. It will be apparent, however, to one skilled in the art that many modifications and changes to the embodiment set forth above are possible without departing from the scope and the spirit of the invention.

What is claimed is:

1. A tool for use in subterranean hydrocarbon production, the tool comprising:

a housing defining an axial flow bore;

a piston sleeve axially moveably disposed within the flow bore between a first position corresponding to a first operating position for the tool, and a second position corresponding to a second operating position for the tool;

an actuation mechanism for moving the tool between the first and second operating positions, the actuation mechanism comprising a ball seat carried by the piston sleeve, the ball seat being formed of dogs upon which an actuation ball can rest and that are moveable radially inwardly and outwardly to capture and release said actuation ball;

wherein:

a) the actuation mechanism moves the tool from the first operating position to the second operating position by landing a first actuation ball onto the ball seat and thereafter varying fluid pressure within the flow bore of the housing;

b) the actuation mechanism moves the tool from the second operating position to the first operating position by landing a second actuation ball that is of a different size than the first actuation ball onto the ball seat after the first actuation ball has been released from the ball seat and thereafter varying fluid pressure within the flow bore of the housing; and an indexing mechanism that governs the axial position of the piston sleeve with respect to the housing, the indexing mechanism comprising:

a) an annular lug pathway having positions corresponding to the tool operating positions; and b) a lug that moves within the lug pathway as the tool is moved between operating positions.

2. The tool of claim 1 wherein the dogs are moveably disposed within slots in the piston sleeve.

3. The tool of claim 2 wherein the actuation mechanism further comprises:

an expansion chamber formed in the housing, the expansion chamber having a plurality of chamber portions of different diameters;

wherein the ball seat provides an opening of a first diameter when the one or more dogs reside within one of said plurality of chamber portions; and the ball seat provides an opening of a second diameter that is larger than the first diameter when the dogs reside within another of said chamber portions.

4. The tool of claim 1 further comprising:

an outer lateral fluid port formed in the housing;

an inner lateral fluid port formed in the piston sleeve;

wherein the inner lateral fluid port is not aligned with the outer lateral port when the tool is in the first operating position; and the inner lateral fluid port is aligned with the outer lateral port when the tool is in the second operating position.

5. The tool of claim 1 further comprising a damping assembly for controlling velocity of relative axial movement of the piston sleeve with respect to the housing.

6. The tool of claim 5 wherein the damping assembly comprises:

a damping chamber defined between the housing and the piston sleeve, the damping chamber being filled with a fluid;

a damping piston affixed to the piston sleeve and disposed within the damping chamber; and a restrictive orifice disposed through the piston to permit fluid to be transferred across the piston.

7. The tool of claim 1 wherein the tool may be cycled between the first and second operating positions repeatedly.

8. A circulation valve tool for use in subterranean hydrocarbon production and comprising:

a housing defining an axial flow bore and having an outer lateral fluid port formed therein;

a piston sleeve axially moveably disposed within the flow bore and having an inner lateral fluid port, the piston sleeve being moveable between a first position corresponding to a first operating position for the tool, and a second position corresponding to a second operating position for the tool;

an actuation mechanism for moving the tool between the first and second operating positions, the actuation mechanism comprising a ball seat carried by the piston sleeve, the ball seat being formed of dogs upon which an actuation ball can rest and that are moveable radially inwardly and outwardly to capture and release said actuation ball;

an indexing mechanism that governs the axial position of the piston sleeve with respect to the housing, the indexing mechanism comprising an annular lug pathway having positions corresponding to the tool operating positions and a lug that moves within the lug pathway as the tool is moved between operating positions; and wherein:

a) the actuation mechanism moves the tool from the first operating position to the second operating position by landing a first actuation ball onto the ball seat and thereafter varying fluid pressure within the flow bore of the housing; and b) the actuation mechanism moves the tool from the second operating position to the first operating position by landing a second actuation ball that is of a different size than the first actuation ball onto the ball seat after the first actuation ball has been released from the ball seat and thereafter varying fluid pressure within the flow bore of the housing;

a first actuation ball; and a second actuation ball which is of a different size than the first actuation ball.

9. The tool of claim 8 wherein the dogs are moveably disposed within slots in the piston sleeve.

10. The tool of claim 8 wherein the actuation mechanism further comprises:

an expansion chamber formed in the housing, the expansion chamber having a plurality of chamber portions of different diameters;

wherein the ball seat provides an opening of a first diameter when is resides within one of said plurality of chamber portions; and the ball seat provides an opening of a second diameter when it resides within another of said chamber portions.

11. The tool of claim 8 further comprising a damping assembly for controlling velocity of relative axial movement of the piston sleeve with respect to the housing.

12. The tool of claim 11 wherein the damping assembly comprises:

a damping chamber defined between the housing and the piston sleeve, the damping chamber being filled with a fluid;

a damping piston affixed to the piston sleeve and disposed within the damping chamber; and a restrictive orifice disposed through the piston to permit fluid to be transferred across the piston.

13. A circulation valve tool for use in subterranean hydrocarbon production and comprising:

a housing defining an axial flow bore and having an outer lateral fluid port formed therein;

a piston sleeve axially moveably disposed within the flow bore and having an inner lateral fluid port, the piston sleeve being moveable between a first position corresponding to a first operating position for the tool, and a second position corresponding to a second operating position for the tool;

an indexing mechanism that governs the axial position of the piston sleeve with respect to the housing, the indexing mechanism comprising an annular lug pathway having positions corresponding to the tool operating positions and a lug that moves within the lug pathway as the tool is moved between operating positions;

an actuation mechanism for moving the tool between the first and second operating positions, the actuation mechanism comprising a ball seat carried by the piston sleeve, the ball seat being formed of dogs upon which an actuation ball can rest and that are moveable radially inwardly and outwardly to capture and release said actuation ball;

wherein the actuation mechanism moves the tool from the first operating position to the second operating position by landing a first actuation ball onto the ball seat and thereafter varying fluid pressure within the flow bore of the housing; and wherein the actuation mechanism moves the tool from the second operating position to the first operating position by landing a second actuation ball that is of a different size than the first actuation ball onto the ball seat after the first actuation ball has been released from the ball seat and thereafter varying fluid pressure within the flow bore of the housing.

14. The circulation valve tool of claim 13 further comprising a damping assembly for controlling velocity of relative axial movement of the piston sleeve with respect to the housing.

15. The tool of claim 14 wherein the damping assembly comprises:

a damping chamber defined between the housing and the piston sleeve, the damping chamber being filled with a fluid;

a damping piston affixed to the piston sleeve and disposed within the damping chamber; and a restrictive orifice disposed through the piston to permit fluid to be transferred across the piston.

16. The tool of claim 13 wherein the actuation mechanism further comprises:

an expansion chamber formed in the housing, the expansion chamber having a plurality of chamber portions of different diameters;

wherein the ball seat provides an opening of a first diameter when it resides within one of said plurality of chamber portions; and the ball seat provides an opening of a second diameter which is larger than the first diameter when it resides within another of said chamber portions.

17. The tool of claim 13 wherein the dogs are moveably disposed within slots in the piston sleeve.

18. The tool of claim 13 wherein the tool may be cycled between the first and second operating positions repeatedly.

* * * * *